United States Patent [19]

Siciliano

[11] 4,026,622

[45] May 31, 1977

[54] ELECTRICAL CONNECTORS AND ASSEMBLY THEREOF

[75] Inventor: Anthony J. Siciliano, Vineland, N.J.

[73] Assignee: Diamond International Corporation, New York, N.Y.

[22] Filed: Apr. 2, 1976

[21] Appl. No.: 672,957

[52] U.S. Cl. ..... 339/65; 339/258 R

[51] Int. Cl.[2] ..... H01R 13/62

[58] Field of Search ..... 339/64–66, 339/195, 196, 252, 258

[56] References Cited

UNITED STATES PATENTS

| | | | |
|---|---|---|---|
| 1,964,471 | 6/1934 | Klingberg | 339/195 R |
| 2,077,587 | 4/1937 | Rowe | 339/64 R |
| 3,862,792 | 1/1975 | Jayne | 339/258 R |

*Primary Examiner*—Joseph H. McGlynn
*Attorney, Agent, or Firm*—Karl W. Flocks

[57] ABSTRACT

Electrical connectors and assembly thereof comprising both male and female connectors formed from spring metal material. The assembly is particularly adaptable for use in automatically establishing electrical contact between the terminal of a self-propelled mobile unit and a fixed terminal. The female connector is formed with a constricted throat defined by first and second portions extending from secured ends to the constricted throat. The first and second portions continue from the throat diverging outwardly therefrom to define a pair of lip elements which facilitate entrance of a male connector by guiding the male connector in forcibly expanding the throat. The female connector member by reason of its spring characteristic grips the male connector to ensure an effective contact. At least one of the male or female connectors are of sufficient breadth to compensate for slight misalignment therebetween. A plurality of both male and female connectors are provided to establish primary and secondary circuits between components on the mobile unit and a fixed station.

11 Claims, 5 Drawing Figures

ELECTRICAL CONNECTORS AND ASSEMBLY THEREOF

BACKGROUND OF THE INVENTION

This invention relates to devices for establishing electrical contact between appliances and/or components carried on a mobile self-propelled unit not depending upon human manipulation such as for use in the system disclosed in co-pending U.S. Patent Application No. 630,015, filed Nov. 7, 1975, also assigned to the Assignee of the present application. As may be seen in the disclosure of the co-pending application mentioned above, the battery supplying the power for a mobile self-propelled feed hopper requires periodic charging and as is frequently the case in any mechanical appliance there is room for development and refinement, in particular in new and improved systems.

In the case of previously known electrical contact devices, contact may be established by mere contact which frequently is insufficient to effect adequate current flow. Also, where human manipulation is not relied upon, there is the possibility of slight misalignment of plug and receptacle connectors which would give rise to need for an attendant to insure electrical contact.

SUMMARY OF THE INVENTION

The invention is directed to electrical connectors designed to provide effective electrical contact between an electrical terminal extending from a mechanized self-propelled mobile unit, in particular a mobile feed dispensing hopper, and a fixed electrical terminal secured at one end of the path of the mobile unit. One feature of the present invention is that it provides an improved electrical terminal arrangement whereby one terminal can automatically move into and out of electrical connecting relationship with reliability and without manual manipulation.

Another feature of the present invention resides in the provision of an improved electrical terminal arrangement whereby an effective connection may be made by terminal elements notwithstanding slight misalignment of one of the elements. Yet another feature of the present invention resides in the provision of an arrangement of electrical terminals whereby a tight electrical connection can be established between terminal elements beyond a mere touching contact.

Other features and advantages of the present invention will become apparent from a reading of the following description thereof taken in conjunction with the accompanying drawings.

DESCRIPTION OF THE INVENTION

Figure 1:
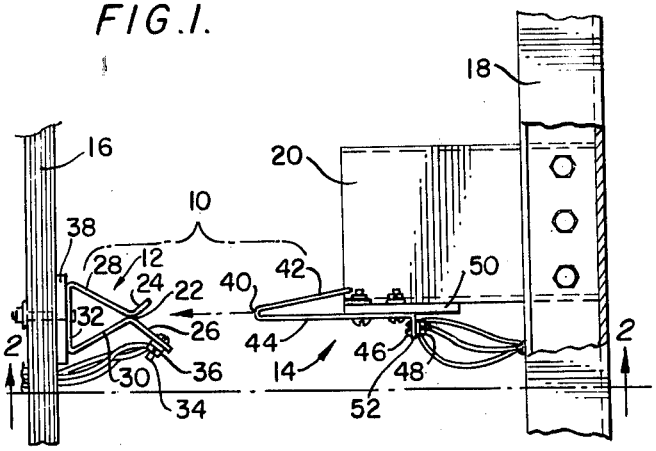
FIG. 1 shows a side elevational view of the electrical connector according to the present invention with the terminal elements out of electrical contact.
Figure 3:
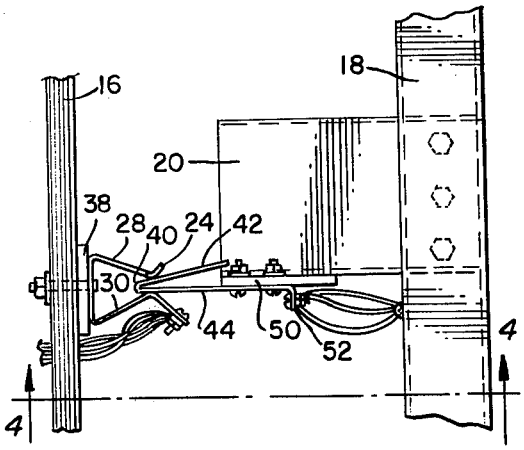
FIG. 3 is a view similar to FIG. 1, but with terminal elements in electrical contact.

Referring now in detail to the drawings and in particular to FIGS. 1 and 3, the reader will readily appreciate that the present invention comprises an electrical connector or contact assembly 10 including a female connector or terminal 12 and a male connector or terminal 14. Female terminal 12 is shown as being secured to a fixed surface or wall 16 while male terminal 14 is secured to a support 20 and projecting out away from a frame 18 of a mechanized mobile unit, for example a mobile feed dispensing unit as disclosed in the co-pending application mentioned above. It is clearly obvious from the intended function of female terminal 12 that it be made from a metal of good electrical conductivity and yet with good spring or resilient characteristics to allow for continued effective useful life.

Figure 2:
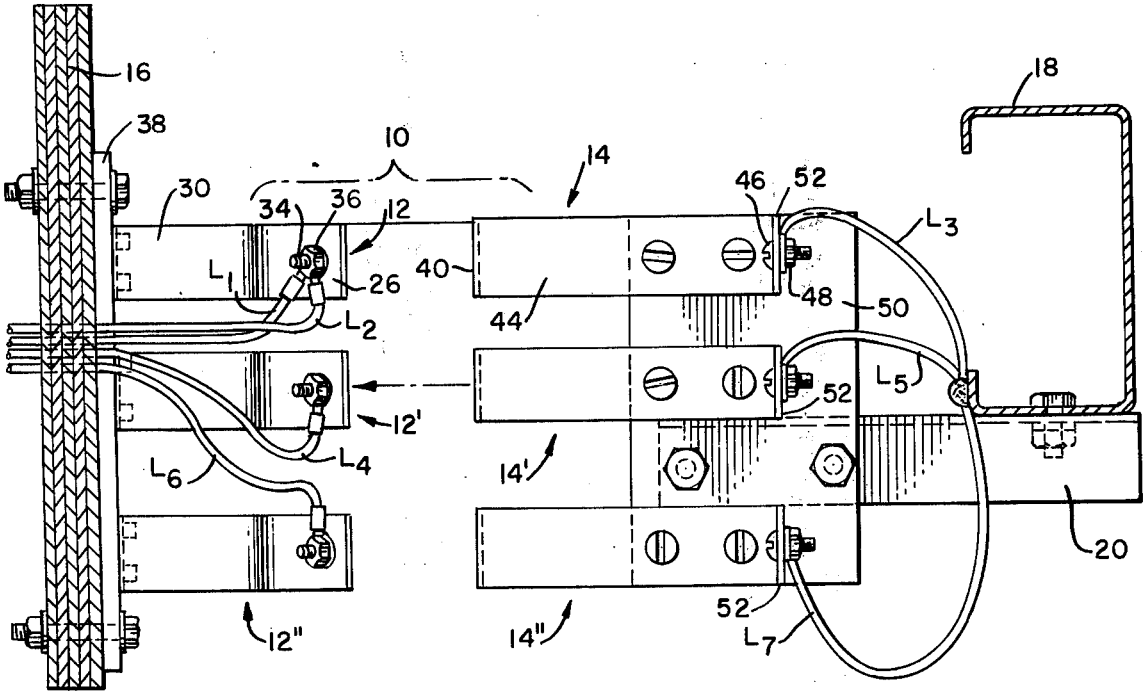
FIG. 2 is an enlarged view taken along the section 2—2 in FIG. 1.

With attention to further details of female terminal 12, it is seen that the terminal 12 comprises a tightly constricted throat 22 formed by intermediate sections 28, 30 which converge to throat 22 from a bridge portion 32 which is integral with spaced-apart ends of intermediate sections 28, 30. Extending in diverging relationship outwardly from throat 22 as extensions of intermediate sections 28, 30 are lips 24, 26, respectively, which together with sections 28, 30 form a Venturi-like structure with throat 22. Terminal screw 34 and nut 36 are provided to connect leads to lip 26 at the underside thereof clear of the path of on-coming male terminal 14. As seen in FIG. 2, leads $L_1$, $L_2$ are connected at lip 26 by screw 34 and nut 36. Lip 26 may for convenience be made longer than lip 24 so that leads connected thereto will not interfere with proper operation thereof. A plurality of terminals 12' and 12'' are seen to be spaced apart from terminal 12 and from each other and secured to wall 16 on a mounting board 38 of insulation or dielectrical material. Terminals 12' and 12'' are connected, for example, to leads $L_4$ and $L_6$ respectively.

Male terminal 14 as seen in FIGS. 1 and 3 comprises a leading nose portion 40 with plate portions 42, 44 converging thereto from a free end and a secured end. Plate portion 42 extends to a free end to allow slight deflection thereof if necessary and plate portion 44 extends therebeneath and is secured to a mounting board 50 of insulation or dielectric material and thereafter extends to a right angled freely extending lead connecting flange 52 to which a lead $L_3$ may be seen to be connected by terminal screw 46 and nut 48 in FIG. 2.

Along with male terminal 14 additional male terminals 14', 14'' are seen in FIG. 2 to be mounted on mounting board. Male terminals 14', 14'' are connected, for example, to leads $L_5$, $L_7$, respectively, so that in connected condition electrical circuitry may be closed with male terminals 14, 14', 14'' inserted in electrical conducting relationship with female terminals 12, 12', 12'', respectively, as seen in FIGS. 3, 4 and 5.

Figure 5:
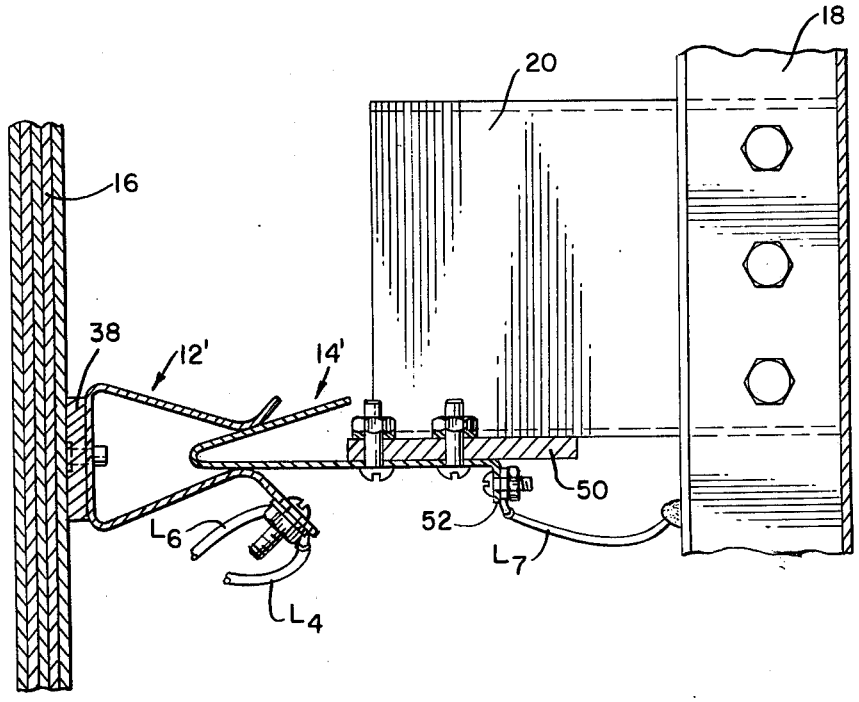
FIG. 5 is a view taken along the section 5—5 in FIG. 4.

Looking in greater detail to FIGS. 1 and 3 or 5, it can be readily seen that as to female terminal 12, the throat 22 is normally closed tightly when male terminal 14 is not disposed in electrical connecting relationship therein, and to ensure good electrical contact and continued good service life female terminal will for optimum purposes be made of a relatively strong spring material to effectively grip plate portions 42, 44 beyond a mere touching contact. From the illustrated construction in FIGS. 1 and 3, it is clear that a slight misalignment in the vertical direction between male and female terminals 14 and 12 will readily be taken into account by virtue of lips 24, 26 diverging from throat 22 of female terminal 12 and the ability of the throat 22 to spread when intermediate sections 28, 30 are sprung apart at the respective connections to bridge portion 32. In this regard lips 24, 26 serve as a guide to direct male terminal 14 into throat 22 of female terminal 12. Male terminal 14 is in a sense in the form of a wedge although it is a slightly deformable wedge. Male terminal, however, need not be in the form of a wedge and further need not be deformable. It is only essential that in the disclosed form of the present invention that female terminal 12 be of sufficiently resilient material as to ensure continued good service life and that it be of such rigidity as to grip the male terminal 14 to ensure good electrical contact.

Figure 4:
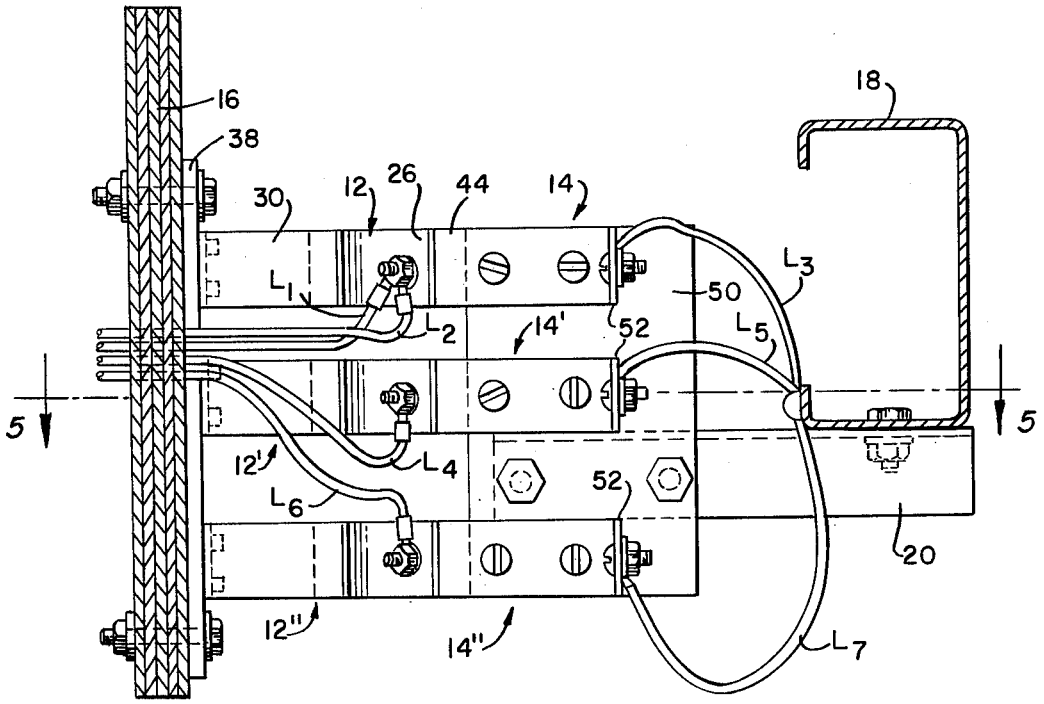
FIG. 4 is a view taken along the section 4—4 in FIG. 3.

Looking at FIGS. 2 and 4, the various terminals 12, 12′, 12″ and 14, 14′, 14″ are of sufficient width to compensate for slight horizontal misalignment therebetween and thus ensure effective electrical contact.

In the arrangement seen in FIG. 2 terminal 12″, for example is a negative terminal and terminal 12 is a positive terminal with leads $L_6$ and $L_2$ from a battery charger connected thereto respectively. Leads $L_1$ and $L_4$ connect to terminals 12 and 12′, respectively, and form part of a control circuit for the battery charging operation. Leads $L_3$ and $L_7$ connect terminals 14 and 14″ to the positive and negative terminals respectively, of a storage battery not illustrated. Lead $L_5$ connects terminal 14′ to part of the battery charging control circuit.

It is to be clearly understood that it is within the concept of the present invention to make either and/or both the female terminals 12, 12′, 12″ and the male terminals 14, 14′, 14″ of a strong but resilient spring material to allow for deformation or deflection of parts to provide good contact despite slight misalignment of parts, to establish a tight electrical contact between parts and recovery of free form upon separation or disengagement of the terminals 14, 14′, 14″ from terminals 12, 12′, 12″.

It will be obvious to those skilled in the art that various changes may be made without departing from the spirit of the invention and the invention is not to be considered limited to what is shown in the drawings and described in the specification.

What is claimed is:

1. Electrical connector member particularly adaptable for use in automatically establishing electrical contact between the terminal of a self-propelled mobile unit and a fixed terminal, said connector being formed from spring metal material and comprising a constricted throat defined by first and second side portions extending from secured ends to said constricted throat, said first and second side portions diverging outwardly from said constricted throat to form first and second lip elements at respective free ends thereof whereby admission of a male connector member into said constricted throat is facilitated as by forced expansion of said throat as guided by either or both of said lip elements, with at least one of said lip elements being substantially longer than the other of said lip elements and electrical lead attaching means being provided adjacent the free end of said one of said lip elements to ensure adequate clearance for a male connector member passing thereby to or from said constricted throat.

2. The connector member of claim 1, wherein said first and second side portions diverge from each other toward said secured ends as well as toward said free ends to provide a Venturi-like appearance.

3. The connector member of claim 2, wherein said first and second side portions are connected to each other at the respective secured ends thereof by a common bridge integral therewith.

4. The connector member of claim 3, wherein said spring metal material from which said connector member is formed is a plate of such breadth that slight misalignment between said connector member and a cooperating male member will be readily compensated to ensure contact therebetween.

5. The combination of the connector member of claim 4 along with one or more like connector members spaced from each other and mounted on an electrically insulated panel secured to a fixed wall whereby a plurality of circuits or portions of a circuit may be established.

6. The combination according to claim 5, wherein a lead from a primary circuit is connected to one of said connector members, a lead from a secondary circuit is connected to a second one of said connector members, and second leads from each of said primary and secondary circuits are connected to a third one of said connector members.

7. The combination according to claim 6, wherein each of said connector members are in contact relationship with a separate male connector having contact portions thereof in the throat of and extending between the sides of said first, second and third connector members.

8. The combination according to claim 7, wherein a first one of said male connectors is connected up with a lead forming one side of said primary circuit, a second one of said male connectors is connected up with a lead forming a part of said secondary circuit, and third one of said male connectors is connected up with a lead forming a second side of said primary circuit.

9. The combination according to claim 8, wherein each of said male connectors is formed of spring metal material having a secured end and a free end, said free end extending in a bent-over portion to form an acute angle with a wedge-like point directed toward the centerline of the throat one of said connector members and with said bent-over portion being resiliently deformable toward said secured end.

10. The connector member of claim 4 in combination with a male connector having contact portions thereof in the throat of and extending between the sides of said connector member.

11. The combination of claim 10, wherein said male connector is formed of spring metal material having a secured end and a free end, said free end extending in a bent-over portion to form an acute angle with a wedge-like point directed toward the centerline of the throat of said connector member with said bent-over portion being resiliently deformable toward said secured end.

* * * * *